United States Patent [19]

Crowell et al.

[11] 3,932,721

[45] Jan. 13, 1976

[54] SEALED SWITCH ACTUATOR

[75] Inventors: Kenneth E. Crowell, Fort Lauderdale, Fla.; William M. Brettman, deceased, late of Margate, Fla., by Donna M. Brettman, administratrix

[73] Assignee: Motorola, Inc., Chicago, Ill.

[22] Filed: Feb. 3, 1975

(Under Rule 47)

[21] Appl. No.: 546,372

[52] U.S. Cl. ..... 200/302; 200/333; 200/159 B

[51] Int. Cl.[2] ..... H01H 13/06

[58] Field of Search ..... 200/153 T, 159 B, 302, 200/333, 340, 329

[56] References Cited

UNITED STATES PATENTS

| | | | |
|---|---|---|---|
| 2,677,730 | 5/1954 | Weidenman, Sr. | 200/333 |
| 3,317,698 | 5/1967 | Mansfield | 200/302 |
| 3,808,389 | 4/1974 | Ramsay | 200/302 |

*Primary Examiner*—Gerald P. Tolin

*Attorney, Agent, or Firm*—James W. Gillman; Donald B. Southard

[57] ABSTRACT

An improved, weather-sealed switch actuator arrangement especially suited for use in electrical or electronic apparatus that may be exposed to hostile ambient conditions. The switch actuator is fabricated of plastic, non-metallic materials wherein a base actuator member is overfitted with a pliant, weather-resistant material, which actuator may be snap-fitted into a recess in the housing of the associated apparatus. A plurality of hook-like tab members on the base actuator cooperate with a plurality of associated apertures in the bottom surface of the housing recess for captivation purposes. A peripheral ridge in the bottom surface of the recess makes a press fit into the material of the overfitted cover to provide a tight, weather-proof seal against water, sand and other dirt particulate. A center portion of the base actuator member is suspended in cantilever fashion with an operating tab or actuator extending laterally inwardly from the free end thereof. The center portion when depressed by the thumb of a user, for example, causes the actuator to extend through and engage the toggle knob of a microswitch device, for example, positioned internally of the apparatus housing.

6 Claims, 4 Drawing Figures

SEALED SWITCH ACTUATOR

BACKGROUND OF THE INVENTION

The present invention relates generally to switch actuators, and more particularly, to an improved, snap-in, water, sand and dirt resistant switch actuator arrangement especially adapted for use with portable communications or other electronic apparatus intended for operation under hostile ambient conditions.

Electronic apparatus is frequently intended for use in hostile environments and under such adverse operating conditions such that reliable operation, without more, may be, and frequently is, impaired. A case in point is portable communications equipment which may be operated by firemen where water spray and standing water and the like are quite prevalent, not to mention smoke, dirt particulate and other abrasive substances that are more often than not stirred up in the ambient and to which the electronic apparatus is subjected to. Policemen, forest rangers, and military personnel are still others who may make use of such equipment under similar operating conditions.

While some degree of weather protection has been afforded in the past for certain of the referenced electronic apparatus as a whole, nevertheless, such measures have not been entirely satisfactory and have left a good deal to be desired. This is particularly so with respect to push-to-talk switch actuators conventionally incorporated in such radio apparatus. Merely putting a rubber jacket or boot over the switch actuator will not provide an effective solution, particularly if the switch actuator protrudes any substantial amount from the surface of the unit. Soft rubber material is easily torn and the switch actuator can be inadvertently operated if the unit is dropped or bumped against a surface or the like. In other instances, the switch mechanism itself has been effectively sealed, or at least not substantially exposed to the ambient, but is intended to be operated by a plastic actuator pivotable about a particularized axis. Nevertheless, water, sand and slush or dirt can still enter the equipment proper through the opening(s) about the actuator, which again may well impair operation.

Accordingly, one object of the present invention is to provide an improved, sealed weather resistant switch actuator for application in associated electronic apparatus which overcomes the aforementioned deficiencies.

A more particular object of the present invention is to provide an improved, sealed switch actuator especially suited for application as a push-to-talk switch control for hand-held two-way communications equipment.

Still another object of the present invention is to provide an improved sealed switch actuator of the foregoing type which makes a snap-in, interference fit within the body of the associated electronic apparatus without further tools or hardware and which may nevertheless be removed for service or other purpose without such special tools or dismantling of the associated electronic apparatus.

Yet another object of the present invention is to provide an improved sealed switch actuator of the foregoing type which provides a flush-fit with the surface of the apparatus in which incorporated to avoid inadvertent actuation and, further, which is completely weather-proof with respect to water spray, sand dirt and other abrasive particulate.

SUMMARY OF THE INVENTION

In practicing the invention, a switch actuator arrangement is provided which includes a base member having a plurality of L-shaped, hook-like members extending laterally outwardly therefrom and which further includes a center portion with a pivotally attached end, and a further free end movable in a direction substantially normal to the plane of the base member. An operating tab extends substantially normal from the free end of the base member. A recess is provided in the housing of the associated electronic apparatus in which the switch actuator is to be incorporated. The recess preferably includes a plurality of apertures for cooperating with the hook tabs of the base member. The recess further includes an upstanding V-shaped ridge extending around the periphery of the bottom surface of the recess. Further, a cover of flexible, non-metallic material is provided which has an in-turned lip dimensioned to effect a close fit over the base member.

Accordingly, the base actuator member and overfitted flexible cover provide a snap-in, flush-fit within the housing recess, whereby the V-shaped upstanding ridge effects a press fit into the material forming the lip of the flexible cover so as to provide effective weather proofing against water, sand and other dirt particulate.

BRIEF DESCRIPTION OF THE DRAWINGS

The features of the present invention, which are believed to be novel, are set forth with particularity in the appended claims. The invention itself, however, together with further objects and advantages thereof, may best be understood by reference to the following description when taken in conjunction with the accompanying drawings, in which:

BRIEF DESCRIPTION OF THE PREFERRED EMBODIMENT

Figure 1:
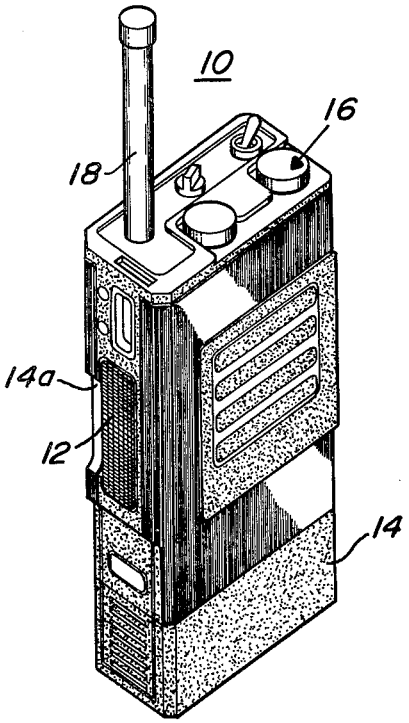
FIG. 1 is a front elevational view in perspective of a hand held portable communications equipment which includes a switch actuator embodying the present invention.
Figure 2:
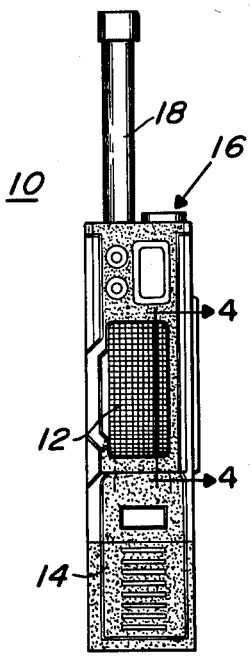
FIG. 2 is a side elevational view of the portable communications equipment shown in FIG. 1.

Referring now to the drawings, a portable, hand-held two-way communication radio 10 is shown in FIGS. 1 and 2, which radio apparatus incorporates a sealed switch actuator 12 which has been constructed in accordance with the present invention. It is to be understood, however, that the referenced switch actuator 12 is not limited solely to applications involving portable communications equipment, but may find advantageous use for application in a wide variety of electrical and electronic apparatus.

In the embodiment as shown in FIGS. 1 and 2, the portable radio unit 10 includes a housing 14 in which the various electrical components (not shown) may be suitably housed. Appropriate controls, such as volume squelch, frequency selection, and the like are included at the top thereof, as shown generally at 16. An antenna 18 extends upwardly from the top of the unit 10, as is customary for such equipment.

In the apparatus 10 as shown, switch actuator 12 functions as the required push-to-talk control for effecting transmitter actuation and the sending of a voice message or the like from the portable radio unit 10. As indicated, actuator 12, when suitably assembled within apparatus 10, makes a substantially flush-fit with respect to the surface of housing 14. Switch actuator 12 is normally operated by holding the unit 10 in the user's hand with the thumb selectively pressing inwardly so as to activate the switch mechanism 13 (FIGS. 3 and 4) positioned internally of the unit whenever the user wishes to make an appropriate transmission. A suitable indentation 14*a* is provided on the back wall of housing 14 so as to permit the thumb of the user to depress the otherwise flush surface of actuator 12, (best seen in FIG. 1).

Figure 3:
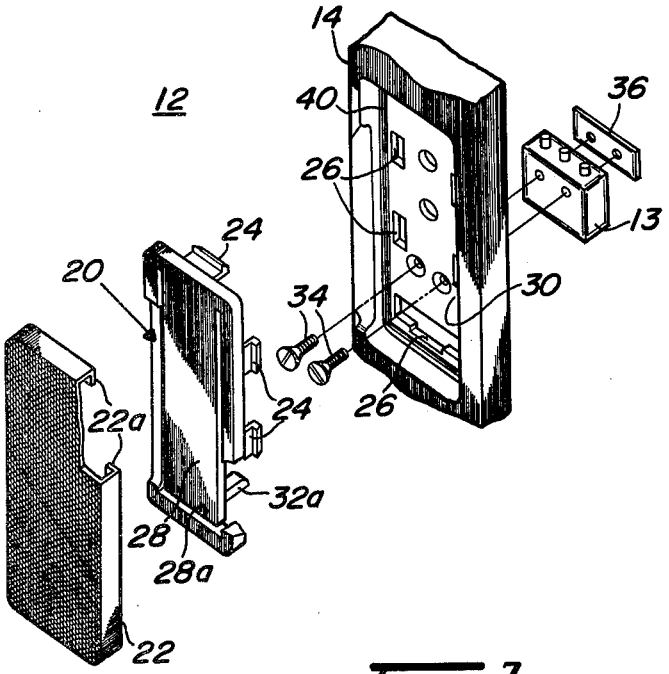
FIG. 3 is an exploded view in perspective of the switch actuator embodying the present invention and incorporated in the communications equipment of FIGS. 1 and 2.
Figure 4:
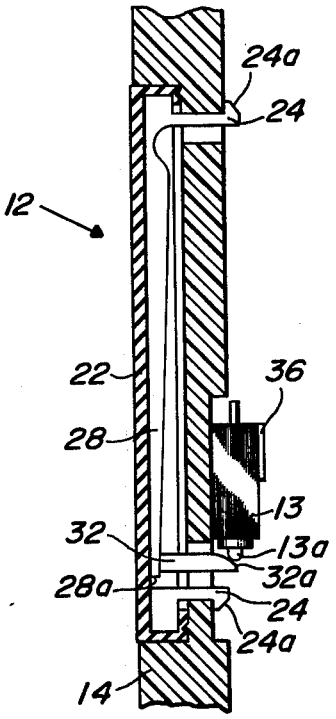
FIG. 4 is a cross sectional view of the switch actuator taken along lines 4—4 of FIG. 3.

As shown in FIG. 3, switch actuator 12 comprises a base member 20 over which a resilient cover 22 is fitted. Cover 22 includes an in-turned lip 22*a* which overlies and fits about the periphery of base member 20. The interfitted base member 20 and overlying cover 22 are then intended to make a snap-in fit within a suitable recess in housing 14, such as that as identified at 30, FIG. 3. This is effected, preferably, by a plurality of hook-like tab extensions 24 extending inwardly substantially normal to the body of base member 20. These tabs are intended to insert through and otherwise engage a corresponding plurality of apertures 26 included in the recess 30 of housing 14. The hook-tab members 24 include a slanting camming surface 24*a* (best seen in FIG. 4) which makes contact with and rides on the side of a particular aperture wall as the base member 20 is pressed into recess 30. The respective tab members 24 are thereby pushed in an inwardly direction until the camming surfaces 24*a* clear the aperture walls, at which time the tabs 24 snap back and overlie a portion of the inner surface of housing 14, as shown in FIG. 4, thereby locking in base member 20 and its overlying cover 22 within recess 30.

Base member 20 further includes a center portion 28 pivotably attached at one end thereof to the perimeter of base member 20 and having a free end, identified generally at 28*a*, movable in a given arc in a direction perpendicular to the plane of the base member 20. An actuator or operating bar 32 extends laterally inwardly from the inner surface of base member 20 and is intended to effect actuation of the switch device 13 itself. This occurs when center portion 28 is suitably depressed to fully thrust the forward end of actuator 32 through its associated aperture 26 and makes contact with a portion of the switch device 13. As best seen in FIG. 4, a curved camming surface 32*a* on the actuator 32 first makes physical contact with a toggle rod 13*a* of switch 13. As switch 32 is moved laterally through the particular aperture 26, camming surface 32*a* provides a progressively greater force on toggle 13*a* which when reaching a predetermined lever causes switch 13*a* to actuate. Switch 13 is positioned on the inner surface of housing 14 such as by machine screws 34 passing through suitable clearance holes in the surface of recess 30 and the body of switch 13 to threadably engage screw threads within a mounting or base plate 36. Other mouting arrangements are of course possible and will be readily apparent to those skilled in the art.

It is intended that an effective water and dirt particulate seal be provided for the switch actuator 12 as a whole. This is accomplished by an upraised, triangular or V-shaped, ridge 40 extending around the periphery of the bottom surface of recess 30, as indicated in FIG. 3, in conjunction with the cover 22. When base member 24 and overfitted cover 22 are snapped into recess 30, the inturned lip 22*a* of resilient material is compressed against the upwardly projecting ridge 40 and held thereby by the hook-like tab members 24 on base member 20 so as to provide an effective water seal at all times and about the entire periphery of recess 30. In practice, a projection on the order of 0.005 to 0.010 inches above the surface of recess 30 by ridge 40 has been found to provide satisfactory operation.

In the preferred form, base member 20 is to be constructed in a one-piece mold configuration from a sturdy, plastic material for strength yet at the same time be capable of effecting the necessary degree of flexibility. One such thermoplastic material found suitable, an acetal resin composition, is marketed under the brand name Delrin. This material has a "memory" such that when flexed or otherwise bent will nevertheless return to its initial steady-state configuration when released. This provides an important attribute for applications of this sort where the component part, such as base member 20, is intended to be flexed a significantly large number of times over an extended service life.

Housing 14 is likewise intended to be constructed of a suitable plastic material, but preferably of a more shock resistant or high impact strength material, such as polycarbonate. The cover 22 should be of a reasonably soft, pliant or easily flexed material, such as polyurethane. Other materials can of course be utilized where preferred or desired.

It will be appreciated, then, that an improved switch actuator arrangement has been set forth and described herein for suitable electronic apparatus application, which arrangement provides a quick, snap-in fit without the need of special tools or the like, and may also be removed or replaced without the need of such special tools, and which further effects a weather tight seal against water, sand and other abrasive dirt particulate. The switch actuator is fabricated from plastic, nonmetallic materials and is reasonably inexpensive to fabricate yet very reliable in operation.

It is to be understood that while only a specific embodiment of the present invention has been shown and described herein, other variations and alternative constructions may be effected without materially departing from the true spirit and scope of the present invention. The appended claims are intended to cover all such modifications and alternative constructions that may fall within the true spirit and scope.

What is claimed is:

1. An improved, weather-resistant switch actuator arrangement for effecting a snap-type, flush-fit within a recess of the associated apparatus, said switch actuator comprising in combination:

a housing having a recessed surface with a plurality of spaced apertures therein;

a base actuator member having a plurality of hook members extending laterally therefrom and extending through said plurality of apertures in said housing recessed surface, said base actuator member further including a center portion having a pivotably attached end and a further free end with an operating tab extending laterally therefrom and movable in a direction substantially normal to the plane of said actuator;

an upstanding ridge positioned about the periphery of said housing recessed surface; and a cover of flexible, non-metallic material having an inturned lip overfitting said base actuator member, said actuator and overfitted cover providing a snap-type fit in said housing recessed surface with said hook members extending through and cooperating with said plurality of apertures, said upstanding ridge press fitting into the material of said lip of said flexible cover so as to provide an effective weather seal between said switch actuator and associated apparatus.

2. An improved switch actuator arrangement in accordance with claim 1 wherein said base actuator member is constructed of a resilient, plastic material having a memory capability so as to return to an initial steady-state configuration after flexure, said cover being constructed of a pliant, water proof material, and said housing being constructed of a rigid, thermoplastic material exhibiting high impact strength.

3. An improved switch actuator arrangement in accordance with claim 2 wherein said base actuator is fabricated from acetal resin, said cover from polyurethane, and said housing from polycarbonate, materials.

4. An improved switch actuator arrangement in accordance with claim 1 wherein said base actuator hook members are of an L-shaped configuration and having a camming surface for engaging the side of said associated recess apertures and guiding said hook members therethrough.

5. An improved switch actuator arrangement in accordance with claim 2 wherein said base actuator and flexible cover members are fabricated in a one-piece molded configurations from said plastic materials.

6. An improved switch actuator arrangement in accordance with claim 1 wherein said upstanding ridge about the periphery of said housing recess is of a substantially V-shaped configuration projecting upwardly from said recess bottom surface on the order of 0.005 to 0.010 inches.

* * * * *